US011339690B2

(12) United States Patent
Vanwingerden et al.

(10) Patent No.: US 11,339,690 B2
(45) Date of Patent: May 24, 2022

(54) BALANCED BRIDGE BLEEDER BRAKE WITH HLA

(71) Applicant: Eaton Intelligent Power Limited, Dublin (IE)

(72) Inventors: Mark Vanwingerden, Battle Creek, MI (US); Andrew Lee, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/146,443

(22) Filed: Jan. 11, 2021

(65) Prior Publication Data

US 2021/0131318 A1 May 6, 2021

Related U.S. Application Data

(63) Continuation-in-part of application No. PCT/EP2019/041649, filed on Jul. 12, 2019.
(Continued)

(51) Int. Cl.
*F01L 13/06* (2006.01)
*F01L 1/18* (2006.01)
(Continued)

(52) U.S. Cl.
CPC ..... *F01L 13/06* (2013.01); *F01L 1/047* (2013.01); *F01L 1/18* (2013.01); *F01L 1/24* (2013.01);
(Continued)

(58) Field of Classification Search
CPC ..... F01L 2001/054; F01L 1/146; F01L 1/181; F01L 1/2411; F01L 2001/2427;
(Continued)

(56) References Cited

U.S. PATENT DOCUMENTS 6,234,143 B1 * 5/2001 Bartel ..... F01L 13/06 123/321
7,617,807 B2 11/2009 Diggs et al.
(Continued)

FOREIGN PATENT DOCUMENTS

WO 2017160379 A1 9/2017

OTHER PUBLICATIONS

International Search Report and Written Opinion for International Application No. PCT/US2019/041649 dated Nov. 6, 2019, 12 pages.

*Primary Examiner* — Jorge L Leon, Jr.
(74) *Attorney, Agent, or Firm* — RMCK Law Group PLC

(57) ABSTRACT

A valvetrain assembly configured to selectively perform a bleeder brake operation includes a rocker arm configured to rotate about a rocker shaft, a camshaft having a lobe configured to impart motion to the rocker arm through a pushrod, and a valve bridge assembly operably associated with the rocker arm and configured to be selectively engaged by the rocker arm to open at least one of a first and second engine valve. An engine brake capsule is operably associated with the valve bridge assembly and configured to operate in a drive mode where the engine brake capsule does not cause the valve bridge assembly to open the first or second engine valves, and a brake mode where the engine brake capsule engages the valve bridge assembly to partially open the first engine valve to perform the bleeder brake operation.

12 Claims, 6 Drawing Sheets

Related U.S. Application Data

(60) Provisional application No. 62/697,119, filed on Jul. 12, 2018.

(51) Int. Cl.

| | |
|---|---|
| ***F01L 1/047*** | (2006.01) |
| ***F01L 1/24*** | (2006.01) |
| ***F01L 1/46*** | (2006.01) |
| ***F01L 1/26*** | (2006.01) |
| *F01L 13/00* | (2006.01) |
| *F01L 1/14* | (2006.01) |
| *F01L 1/245* | (2006.01) |

(52) U.S. Cl.
CPC ..... *F01L 1/26* (2013.01); *F01L 1/267* (2013.01); *F01L 1/46* (2013.01); *F01L 1/146* (2013.01); *F01L 1/181* (2013.01); *F01L 1/2411* (2013.01); *F01L 13/0005* (2013.01); *F01L 2001/054* (2013.01); *F01L 2001/2427* (2013.01); *F01L 2001/256* (2013.01); *F01L 2305/00* (2020.05)

(58) Field of Classification Search
CPC ..... F01L 2001/256; F01L 1/26; F01L 1/267; F01L 13/0005; F01L 13/06
USPC ..... 123/90.4, 90.46, 90.55, 90.61
See application file for complete search history.

(56) References Cited

U.S. PATENT DOCUMENTS

| | | | | |
|---|---|---|---|---|
| 7,900,597 | B2 | 3/2011 | Meneely et al. | |
| 8,037,865 | B2 | 10/2011 | Meneely et al. | |
| 8,272,363 | B2 | 9/2012 | Meneely et al. | |
| 9,016,249 | B2 | 4/2015 | Roberts et al. | |
| 2006/0225684 | A1* | 10/2006 | Spath | F01L 1/146 123/90.59 |
| 2010/0024767 | A1 | 2/2010 | Meneely et al. | |
| 2012/0024260 | A1* | 2/2012 | Groth | F01L 13/0005 123/321 |
| 2015/0354418 | A1* | 12/2015 | Jo | F01L 9/12 123/323 |
| 2017/0175597 | A1* | 6/2017 | Cecur | F01L 13/06 |
| 2017/0241305 | A1 | 8/2017 | Xi et al. | |
| 2017/0276034 | A1* | 9/2017 | Cecur | F01L 1/181 |
| 2018/0003088 | A1* | 1/2018 | Nielsen | F01L 1/2405 |
| 2018/0087412 | A1* | 3/2018 | Andrisani | F01L 1/18 |
| 2019/0010835 | A1* | 1/2019 | McCarthy, Jr. | F01L 13/06 |
| 2019/0055861 | A1* | 2/2019 | Persson | F01L 1/181 |

* cited by examiner

BALANCED BRIDGE BLEEDER BRAKE WITH HLA

CROSS REFERENCE TO RELATED APPLICATIONS

This application is a continuation-in-part of International Application No. PCT/US2019/041649 filed Jul. 12, 2019, which claims the benefit of U.S. Provisional Application No. 62/697,119, filed Jul. 12, 2018, the contents of which are incorporated herein by reference thereto.

FIELD

The present disclosure generally relates to valvetrain assemblies for internal combustion engines and, more particularly, to a valvetrain assembly for bleeder braking.

BACKGROUND

Engine braking can be used to retard forces within an engine to ultimately slow a vehicle down. In a typical valve train assembly used with an engine brake, an exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it.

One form of engine braking includes a bleeder brake. Bleeder brakes can be used as auxiliary brakes, in addition to wheel brakes, on relatively large vehicles, for example trucks, powered by heavy or medium duty diesel engines. A bleeder brake typically includes a piston that selectively extends to a full stroke. In the full stroke, the piston can maintain an exhaust valve open a fixed amount throughout an engine cycle. As a result, a mechanical gap can be generated in the valve train. In many instances, such a gap can be incompatible with a common hydraulic lash adjuster (HLA). A hydraulic lash adjuster may also be provided in the valve train assembly to remove any lash or gap that develops between the components in the valve train assembly. The mechanical gap can allow the HLA to unfavorably pump-up preventing the exhaust valves to close once the bleeder brake is deactivated.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

According to various aspects of the present disclosure, a valvetrain assembly configured to selectively perform a bleeder brake operation is provided. In one example the valvetrain assembly includes a rocker arm configured to rotate about a rocker shaft, a camshaft having a lobe configured to impart motion to the rocker arm through a pushrod, and a valve bridge assembly operably associated with the rocker arm and configured to be selectively engaged by the rocker arm to open at least one of a first and second engine valve. An engine brake capsule is operably associated with the valve bridge assembly and configured to operate in a drive mode where the engine brake capsule does not cause the valve bridge assembly to open the first or second engine valves, and a brake mode where the engine brake capsule engages the valve bridge assembly to partially open the first engine valve to perform the bleeder brake operation.

In addition to the foregoing, the described valvetrain assembly may include one or more of the following features: a hydraulic lash adjustment (HLA) lifter disposed between the camshaft and the pushrod; wherein the HLA lifter is a deactivating HLA lifter; wherein the HLA lifter is a roller lifter; wherein the valve bridge assembly includes a lever assembly disposed within a bridge main body; wherein the lever assembly includes a lever pivotably coupled to the bridge main body by a bridge pin, the lever configured to engage the first engine valve; wherein the lever assembly further includes a valve shoe pivotably coupled to the lever by a valve shoe pin; wherein the valve shoe pin is limited in upward movement by a pair of stop arms extending from the bridge main body; and wherein in the brake mode, the lever is selectively engaged by the engine brake capsule, thereby causing rotation about the bridge pin and upward movement of the bridge main body, the upward movement causing rotation of the rocker arm and a downward reaction force into a hydraulic lash adjuster (HLA) lifter to prevent pump-up thereof.

In addition to the foregoing, the described valvetrain assembly may include one or more of the following features: wherein valve bridge assembly is a pass-through bridge assembly having a pin assembly disposed within a bridge main body; wherein the pin assembly is disposed within a bore formed in the bridge main body and includes a contact pin and a valve shoe, the contact pin configured to be engaged by the engine brake capsule in the brake mode to impart movement to the valve shoe to thereby engage the first engine valve; and wherein the contact pin extends through an aperture formed in the bridge main body, and wherein a shoulder that at least partially defines the bore and the aperture is configured to limit upward movement of the valve shoe.

In addition to the foregoing, the described valvetrain assembly may include one or more of the following features: wherein the valve bridge assembly is a solid bridge assembly having a first end configured to engage and pivot on the first engine valve, and a second end configured to engage and pivot on the second engine valve; wherein the engine brake capsule comprises an outer body defining an upper chamber and a lower chamber; wherein the engine brake capsule further comprises a pin and a biasing mechanism disposed in the upper chamber, the biasing mechanism configured to bias the pin downward toward the lower chamber; wherein the engine brake capsule further comprises a plunger and check ball assembly disposed in the lower chamber, the plunger configured to slide along the lower chamber between a retracted position and an extended position; and wherein the check ball assembly comprises a check ball, a seat, and a biasing mechanism configured to bias the check ball toward the upper chamber to seal a passage.

In another aspect, a method of operating a valvetrain assembly having a rocker arm configured to rotate about a rocker shaft, a camshaft having a lobe configured to impart motion to the rocker arm through a pushrod, a valve bridge assembly operably associated with the rocker arm and configured to be selectively engaged by the rocker arm to open at least one of a first and second engine valve, and an engine brake capsule operably associated with the valve bridge assembly is provided. In one example, the method includes operating in a drive mode where the engine brake capsule does not cause the valve bridge assembly to open the first or second engine valves, and operating in a brake mode where the engine brake capsule engages the valve bridge assembly to partially open the first engine valve to perform a bleeder brake operation.

In addition to the foregoing, the described method may include one or more of the following features: wherein operating in the brake mode comprises supplying pressurized fluid to the engine brake capsule; and wherein operating in the drive mode comprises not supplying pressurized fluid to the engine brake capsule.

BRIEF DESCRIPTION OF THE DRAWINGS

The present disclosure will become more fully understood from the detailed description and the accompanying drawings, wherein.

and

Figure 6:
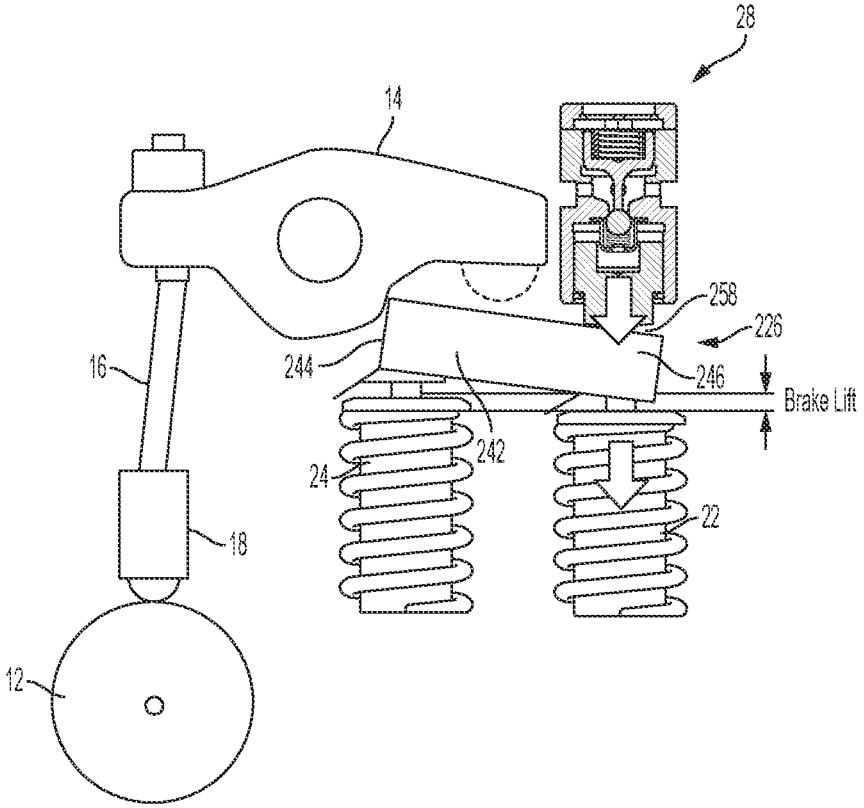
Figure 7:
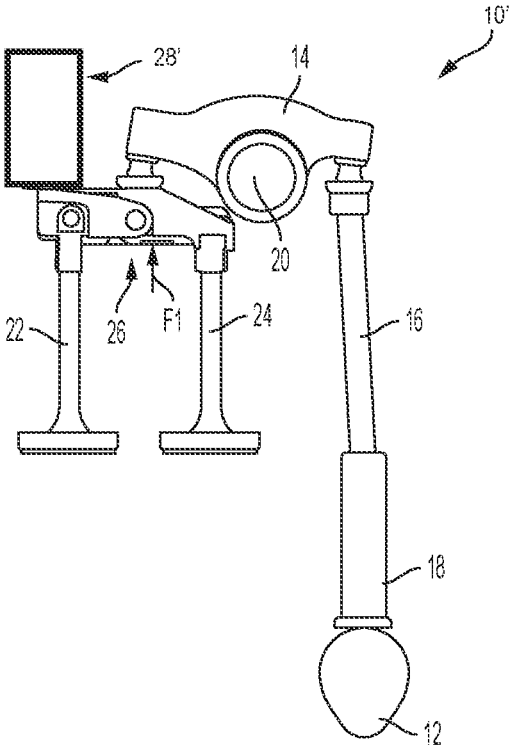

FIG. 6 is a side view of a valvetrain assembly and valve bridge assembly constructed in accordance to yet another example of the present disclosure.

DETAILED DESCRIPTION

Described herein are systems and methods incorporating a bleeder brake with a hydraulic lash adjuster (HLA) by utilizing a balanced valve bridge with a pivot arm in a diesel engine valvetrain. A bleeder brake, which holds an exhaust valve open to generate brake power, can cause a valvetrain with an HLA to "pump-up" and prevent the exhaust valve from closing during normal drive mode operation. The systems described herein utilizes a fixed brake capsule with oil control to hold open one exhaust valve during engine braking operations, which is commonly referred to as a "bleeder brake." The additional use of a balanced valve bridge featuring an offset pivot arm can generate a reaction load when acted upon by the fixed brake capsule. This reaction force is translated back into the normal valvetrain to facilitate preventing the HLA pump-up (e.g., expansion).

During bleeder engine braking, in addition to the main exhaust valve event, one or more exhaust valves are held open throughout the remaining engine cycles (i.e., the intake, compression, and expansion cycles) for a full-cycle bleeder brake or during a portion of the remaining cycles (e.g., the compression and expansion cycles) for a partial-cycle bleeder brake.

Figure 1:
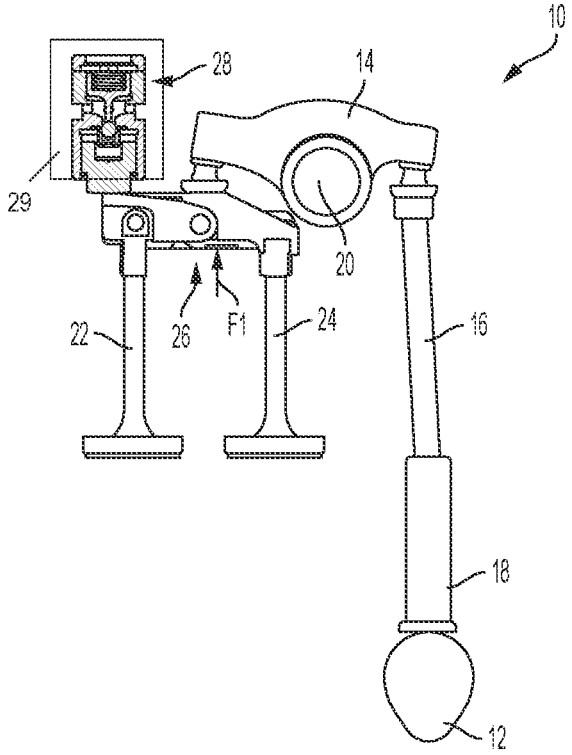
FIG. 1 is a partial sectional view of a valvetrain assembly constructed in accordance to one example of the present disclosure.

With initial reference to FIG. 1, an exemplary valve train assembly constructed in accordance to one example of the present disclosure is shown and generally identified at reference 10. The valve train assembly 10 can generally include a cam shaft 12 with one or more lobes configured to indirectly drive a first end of a rocker arm 14 via a pushrod 16.

In some examples, a hydraulic lash adjuster (HLA) lifter 18 is implemented between the cam lobe 12 and the pushrod 16. In other examples, HLA lifter 18 is a deactivating HLA roller lifter configured to operate between an activated mode and a deactivated mode. In the activated mode, HLA roller lifter 18 transfers motion of the cam lobe 12 to the pushrod 16 to cause rotational movement of rocker arm 14. In the deactivated mode, HLA roller lifter 18 absorbs the motion of cam lobe 12 such that lifter 18 does not impart motion to pushrod 16 and cause rotation of rocker arm 14.

In operation, as the cam lobe 12 rotates, the rocker arm 14 pivots about a fixed rocker shaft 20 and the opposite second end of the rocker arm 14 actuates one or more engine valves 22, 24 via a balanced valve bridge assembly 26.

A brake capsule 28 is fixed to a cylinder head of the engine (not shown) and is configured to selectively extend to hold valve 22 open during a predetermined time (e.g., during all engine strokes creating brake power). When activated, brake capsule 28 moves from a retracted position to an extended position to contact the valve bridge assembly 26. This causes the valve bridge assembly 26 to generate a reaction force 'F1' into the rocker arm 14, which is then translated to HLA lifter 18 to prevent pump-up when braking is activated.

Figure 2:
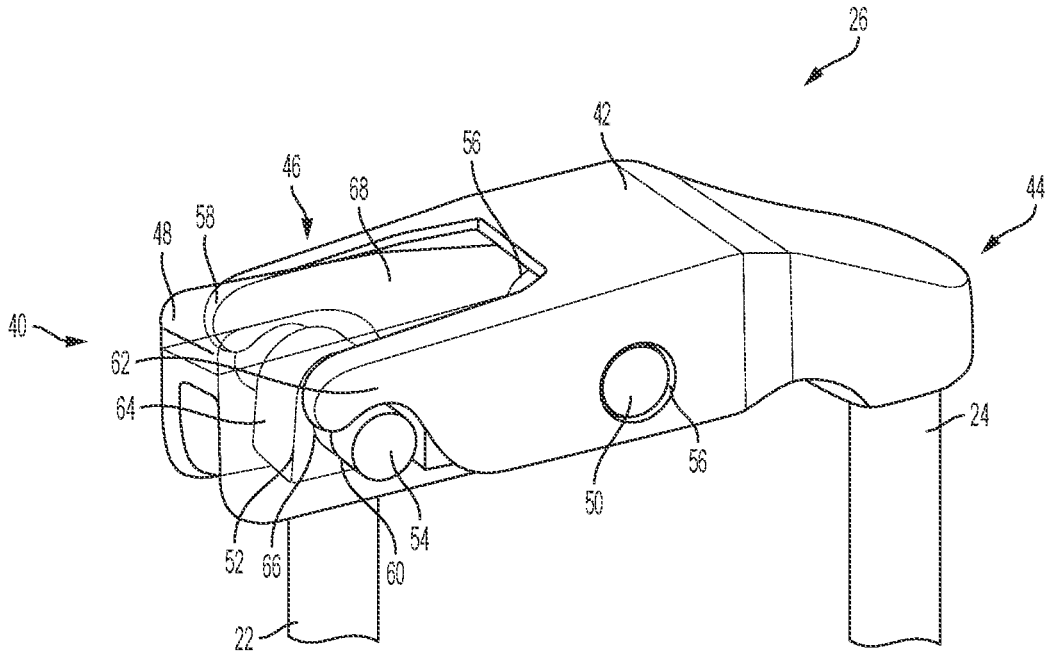
FIG. 2 is a perspective view of a valve bridge assembly of the valvetrain assembly shown in FIG. 1 constructed in accordance to one example of the present disclosure.

With reference now to FIG. 2, the valve bridge assembly 26 will be described in more detail. As illustrated, the valve bridge assembly 26 includes a lever assembly 40 disposed within a bridge main body 42. The bridge main body 42 includes a first end 44 and a second end 46. The first end 44 can be configured to engage valve 24, and the lever assembly 40 can be pivotably coupled to the second end 46.

In the example embodiment, the lever assembly 40 generally includes a pivot arm or lever 48, a pivot axle or bridge pin 50, an e-foot or valve shoe 52, and an e-foot axle or valve shoe pin 54. The lever 48, which is shown transparent in FIG. 2, can be pivotably coupled to the bridge main body 42 by the bridge pin 50, which extends through opposed apertures 56 formed in the bridge main body 42.

In the illustrated example, the lever 48 generally includes an engagement surface 58 and opposed openings 60. The engagement surface 58 is configured to be selectively engaged by brake capsule 28, as described herein in more detail, and the opposed openings 60 are configured receive the valve shoe pin 54, which is limited in upward movement by stop arms 62 of the bridge main body 42.

In the example embodiment, the valve shoe 52 can include a main body 64 having an aperture 66 formed therein. The main body 64 is configured to receive a portion of the valve 22, and the aperture 66 is configured to receive the valve shoe pin 54 therethrough.

Accordingly, lever 48 can be selectively engaged at the engagement surface 58, which can cause rotation about bridge pin 50 and upward movement of an opposed end 68 of the lever that is opposite surface 58. This upward movement of lever end 68 is transferred via bridge pin 50 to cause upward movement of bridge main body 42, which in turn causes rotation of the rocker arm 14 and a downward reaction force into HLA lifter 18 to prevent pump-up.

Figure 5:
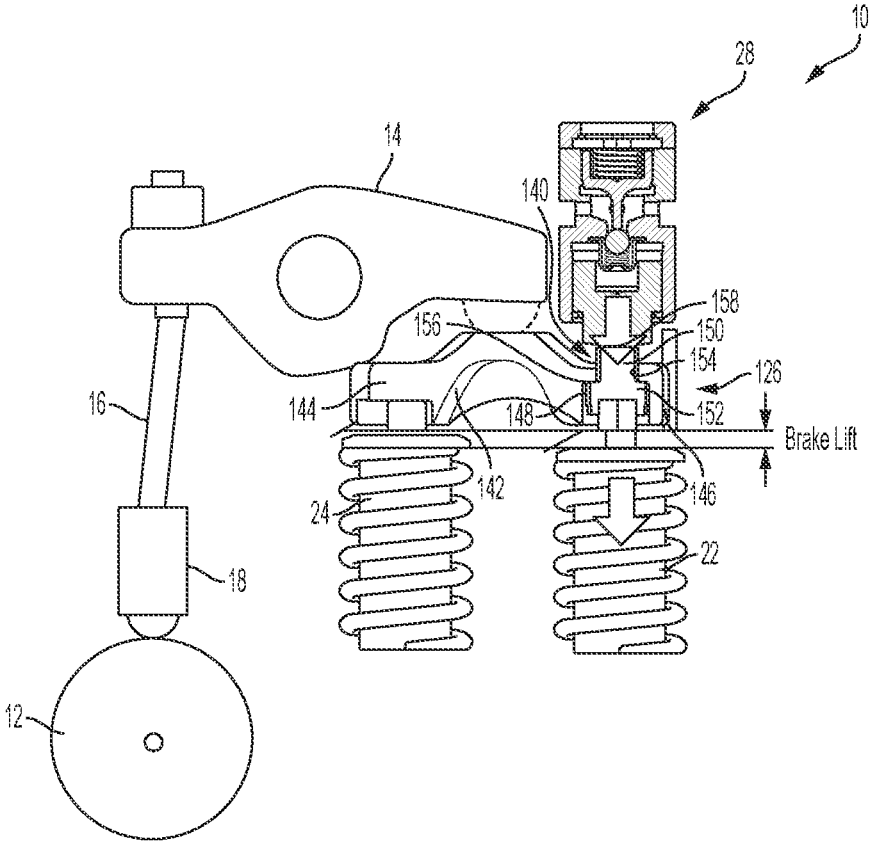
FIG. 5 is a side view of a valvetrain assembly and valve bridge assembly constructed in accordance to another example of the present disclosure.

Although described as a balanced valve bridge assembly 26, it will be appreciated that other arrangements and valve bridge assemblies may be utilized with the systems described herein. For example, FIG. 5 illustrates an alternative embodiment utilizing a pass-through bridge assembly 126, and FIG. 6 illustrates an alternative embodiment utilizing a solid bridge assembly 226.

Figure 3:
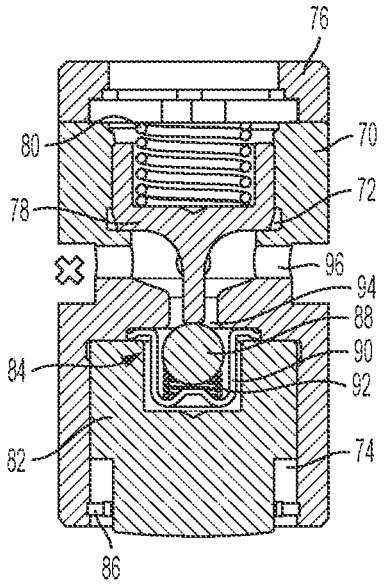
FIG. 3 is a cross-sectional view of an engine brake capsule of the valvetrain assembly shown in FIG. 1, in a first mode, and constructed in accordance to one example of the present disclosure.
Figure 4:
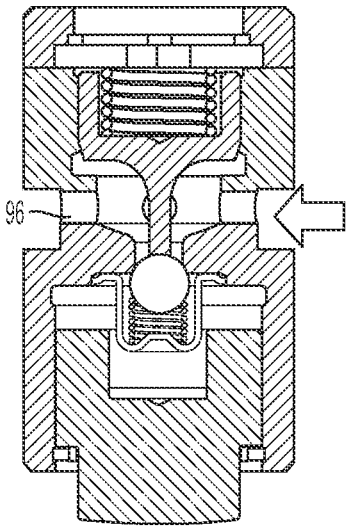
FIG. 4 is the engine brake capsule shown in FIG. 3 in a second mode.

With reference now to FIGS. 3 and 4, the engine brake capsule 28 will be described in more detail. In the example embodiment, the brake capsule 28 generally includes an outer body 70 defining an upper chamber 72 and a lower chamber 74. A cap 76 seals an upper end of the upper chamber 72, and a pin 78 and a biasing mechanism 80 (e.g., a spring) are disposed in the upper chamber 72. The biasing mechanism 80 is configured to bias the pin 78 downward toward the lower chamber 74.

In the illustrated example, a plunger 82 and check ball assembly 84 are disposed in the lower chamber 74. The plunger 82 is configured to slide along lower chamber 74 between a retracted position (FIG. 3) and an extended position (FIG. 4). A clip or stop 86 is configured to limit downward movement of plunger 82. Check ball assembly 84 can include a check ball 88, a seat 90, and a biasing mechanism 92 (e.g., a spring). The biasing mechanism 92 is configured to bias the check ball 88 toward the upper chamber 72 to seal a passage 94.

In the example implementation, engine brake capsule 28 is operable in a drive mode (FIG. 3) and a brake mode (FIG. 4). In the drive mode, pressurized fluid is not supplied to engine brake capsule 28, in particular to the lower chamber 74 such that plunger 82 is collapsed or retracted into the lower chamber 74. In brake mode, pressurized fluid (e.g., oil) is supplied to engine brake capsule 28 via one or more ports 96. The pressurized fluid enters and fills lower chamber 74 via passage 94 as pin 78 biases check ball 88 downward. This forces plunger 82 downward into the extended position to contact engagement surface 58 to facilitate performing a bleeder brake operation.

With reference now to FIG. 5, valve train assembly 10 is shown with balanced valve bridge assembly 26 replaced by the pass-through bridge assembly 126. In the example embodiment, pass-through bridge assembly 126 generally includes a pin assembly 140 disposed within a bridge main body 142. The bridge main body 142 includes a first end 144 and a second end 146. The first end 144 can be configured to engage valve 24, and the pin assembly 140 is slidingly disposed within the second end 146.

In the example embodiment, the pin assembly 140 is disposed within a cutout or bore 148 formed in the bridge second end 146 and generally includes a contact pin 150 and a valve shoe 152. The contact pin 150 extends through an aperture 154 formed in the bridge second end 146, and the valve shoe 152 is limited in upward movement by stops or shoulders 156 that partially define the bore 148 and aperture 154. The contact pin 150 includes an engagement surface 158, and the valve shoe 152 is configured to receive a portion of the valve 22.

Accordingly, in the drive mode, pressurized fluid is not supplied to engine brake capsule 28, and plunger 82 is retracted into the lower chamber 74 and does not engage contact pin 150. In the brake mode, pressurized fluid is supplied to engine brake capsule 28 to force plunger 82 downward into the extended position to contact the engagement surface 158, thereby opening valve 22 to facilitate performing a bleeder brake operation.

With reference now to FIG. 6, valve train assembly 10 is shown with balanced valve bridge assembly 26 replaced by the solid bridge assembly 226. In the example embodiment, solid bridge assembly 226 generally includes a bridge main body 242 having a first end 244 and a second end 246. The first end 244 can be configured to engage and pivot on valve 24, the second end 246 can be configured to engage and pivot on valve 22.

Accordingly, in the drive mode, pressurized fluid is not supplied to engine brake capsule 28, and plunger 82 is retracted into the lower chamber 74 and does not engage bridge second end 246. In the brake mode, pressurized fluid is supplied to engine brake capsule 28 to force plunger 82 downward into the extended position to contact an engagement surface 258 of the second end 246, thereby opening valve 22 to facilitate performing a bleeder brake operation.

Described herein are systems and methods for incorporating a bleeder brake with a hydraulic lash adjuster (HLA) by utilizing a valve bridge assembly. A brake capsule is movable between a retracted position and an extended position, which is configured to engage a portion of the valve bridge assembly and open an exhaust valve a predetermined distance to perform a bleeder brake operation.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A valvetrain assembly configured to selectively perform a bleeder brake operation, the valvetrain assembly comprising:

a rocker arm configured to rotate about a rocker shaft;

a camshaft having a lobe configured to impart motion to the rocker arm through a pushrod;

a valve bridge assembly operably associated with a first engine valve and a second engine valve, the valve bridge configured to be selectively engaged by the rocker arm so as to open at least one engine valve of the first and second engine valves, wherein the valve bridge assembly includes a lever assembly disposed within a bridge main body wherein the lever assembly includes a lever pivotally coupled to the bridge main body via a bridge pin, the lever configured to engage the first engine valve; and an engine brake capsule operably associated with the valve bridge assembly, the engine brake capsule being fixed to a cylinder head, the engine brake capsule configured to operate in a drive mode where the engine brake capsule does not cause the valve bridge assembly to open the at least one engine valve, and a brake mode where the engine brake capsule engages the valve bridge assembly so as to partially open the first engine valve which effectuates the bleeder brake operation wherein in the brake mode, the lever is selectively engaged by the engine brake capsule, thereby causing rotation about the bridge pin and upward movement of the bridge main body, the upward movement causing rotation of the rocker arm and a downward reaction force into a hydraulic lash adjuster (HLA) lifter so as to prevent a pump-up of the HLA lifter.

2. The valvetrain assembly of claim 1, wherein the HLA lifter is disposed between the camshaft and the pushrod.

3. The valvetrain assembly of claim 2, wherein the HLA lifter is a deactivating HLA lifter.

4. The valvetrain assembly of claim 2, wherein the HLA lifter is a roller lifter.

5. The valvetrain assembly of claim 1, wherein the lever assembly further includes a valve shoe pivotally coupled to the lever via a valve shoe pin.

6. The valvetrain assembly of claim 5, wherein the valve shoe pin is limited in upward movement via a pair of stop arms extending from the bridge main body.

7. The valvetrain assembly of claim 1, wherein the valve bridge assembly is a solid bridge assembly having a first end configured to engage and pivot on the first engine valve, and a second end configured to engage and pivot on the second engine valve.

8. The valvetrain assembly of claim 1, wherein the engine brake capsule comprises an outer body defining an upper chamber and a lower chamber and wherein the engine brake capsule is configured for hydraulic actuation.

9. The valvetrain assembly of claim 8, wherein the engine brake capsule further comprises a pin and a biasing mechanism disposed in the upper chamber, the biasing mechanism configured to bias the pin downward toward the lower chamber.

10. The valvetrain assembly of claim 8, wherein the engine brake capsule further comprises a plunger and check ball assembly disposed in the lower chamber, the plunger configured to slide along the lower chamber between a retracted position and an extended position, wherein the check ball assembly comprises a check ball, a seat, and a biasing mechanism configured to bias the check ball toward the upper chamber so as to seal a passage.

11. A method of operating a valvetrain assembly having a rocker arm configured to rotate about a rocker shaft, a camshaft having a lobe configured to impart motion to the rocker arm through a pushrod, a valve bridge assembly operably associated with a first engine valve and a second engine valve, the valve bridge configured to be selectively engaged by the rocker arm so as to open at least one engine valve of the first and second engine valves, wherein the valve bridge assembly includes a lever assembly disposed within a bridge main body wherein the lever assembly includes a lever pivotally coupled to the bridge main body via a bridge pin, the lever configured to engage the first engine valve, and an engine brake capsule fixed to a cylinder head and operably associated with the valve bridge assembly, the method comprising:

operating in a drive mode where the engine brake capsule does not cause the valve bridge assembly to open the at least one engine valve; and operating in a brake mode where the engine brake capsule engages the valve bridge assembly so as to partially open the first engine valve which effectuates a bleeder brake operation wherein in the brake mode, the lever is selectively engaged by the engine brake capsule, thereby causing rotation about the bridge pin and upward movement of the bridge main body, the upward movement causing rotation of the rocker arm and a downward reaction force into a hydraulic lash adjuster (HLA) lifter so as to prevent a pump-up of the HLA lifter.

12. The method of claim 11, wherein the operating in the brake mode comprises supplying pressurized fluid to the engine brake capsule and wherein the operating in the drive mode comprises draining the engine brake capsule of the pressurized fluid.

* * * * *